United States Patent [19]

Haubrich et al.

[11] 4,145,145

[45] Mar. 20, 1979

[54] GUIDE FOR A PRINTING HEAD OF A PRINTING DEVICE

[75] Inventors: Lothar Haubrich, Eiserfeld; Heinrich Dürr, Wilnsdorf-Niederdielven, both of Fed. Rep. of Germany

[73] Assignee: U.S. Philips Corporation, New York, N.Y.

[21] Appl. No.: 785,970

[22] Filed: Apr. 8, 1977

[30] Foreign Application Priority Data

Apr. 22, 1976 [DE] Fed. Rep. of Germany ..... 2617562

[51] Int. Cl.[2] ..... B41J 3/10

[52] U.S. Cl. ..... 400/124; 400/354; 400/357

[58] Field of Search ..... 197/1 R, 16, 18, 55, 197/53; 101/93.05

[56] References Cited

U.S. PATENT DOCUMENTS

| | | | |
|---|---|---|---|
| 3,442,365 | 5/1969 | Ragland et al. | 197/55 X |
| 3,592,311 | 7/1971 | Chou et al. | 197/1 R |
| 3,627,096 | 12/1971 | Finnegan | 197/1 R |
| 3,670,861 | 6/1972 | Zenner et al. | 197/1 R X |
| 3,910,395 | 10/1975 | Colglazier et al. | 197/1 R |
| 3,960,256 | 6/1976 | Bickoff et al. | 197/1 R |

*Primary Examiner*—Ernest T. Wright, Jr.

*Attorney, Agent, or Firm*—David R. Treacy; Robert S. Smith

[57] ABSTRACT

A guide for directing a printing head parallel to a printing direction in a printing device, the said printing head being displaceable along two parallel, round guide rods which are maintained at a fixed distance from each other by sheet-metal clamps which extend transversely of the longitudinal direction of the rods and which are provided with bearing apertures in which the guide rods are clamped. The guide offers a comparatively high resistance against bending, so that a constant distance is maintained between printing head and record carrier.

3 Claims, 5 Drawing Figures

GUIDE FOR A PRINTING HEAD OF A PRINTING DEVICE

Figure 1:
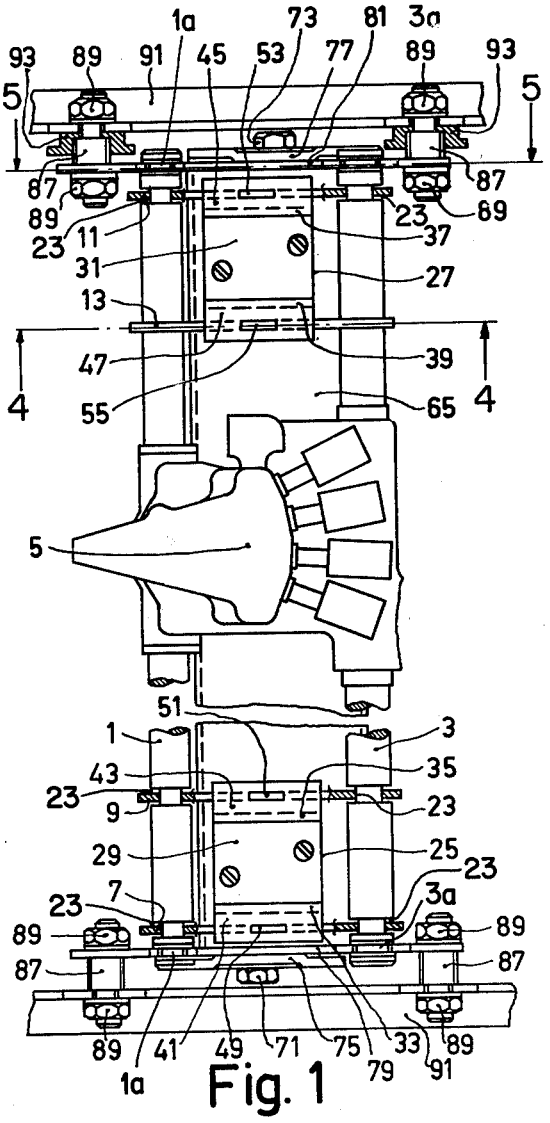

The invention relates to a guide for the displacement of a printing head parallel to the printing direction in a printing device. The printing head is displaceable along two parallel round guide rods which are secured in the frame of the printing device near both their ends by means of side plates which extend transversely of the guide rods.

Comparatively long guide rods are often required for the linear guiding of a printing head of a printing device. Long guide rods of this kind occur notably in office machines utilising two printing heads which operate simultaneously or individually and which are displaceable along different parts of one and the same guide. The guide rods may be secured to the frame of the printing device directly as well as indirectly by means of side plates which extend transversely of the guide rods. Guides of printing heads impose a problem in that a compromise must be found between a construction having a comparatively low weight and a comparatively high resistance against bending. Bending may be due to the weight of the printing head itself as well as to reaction forces on the guide rods. These reaction forces occur when use is made of a printing head comprising mechanical impact elements such as, for example, the printing pins of a matrix printer. Bending of the guide rods causes on the one hand curved lines on the record carrier and on the other hand differences in contrast of the characters printed. Differences in contrast of this kind are caused by a non-constant distance between the ends of the printing pins and the record carrier. The parallel relationship of the guide rods is, therefore, of essential importance. Furthermore, it is very desirable to connect not only the printing head to be detachable on the guide rods (as is usually the case), but also to connect the guide rods themselves to be readily detachable in the frame of the printing device. In the case of wear, it is highly desirable to quickly replace the printing head and the guide rods as one unit as well as to replace the printing head and the guide rods separately. Finally, the guide rods must be accurately positioned as a unit, relative to the printing direction in order to ensure a constant distance between the printing head and record carrier.

The invention has for its object to provide a guide for a printing head which offers a comparatively high resistance against bending, which has a comparatively light construction and which can also be readily and quickly replaced in the case of wear.

To this end, a guide in accordance with the invention is characterized in that the guide rods are maintained at a given, fixed distance from each other by at least two clamps, provided near each of their ends, which extend transversely of the longitudinal direction of the rods and which are made of sheet metal, the said clamps being provided with two communicating bearing apertures, the edges of which are clamped about circumferential grooves of the relevant guide rod, while an elongate, flexible bridge portion is situated between the two bearing apertures is located under a given press-on force between a supporting beam which is detachably arranged in the frame of the printing device and which extends parallel to the guide rods, and a bent-over portion of a leg of a U-shaped clamping bracket which extends in the longitudinal direction of the supporting beam, the bottom portion of the said clamping bracket being detachably secured to the supporting beam between two clamps of a pair.

The invention will be described in detail hereinafter with reference to the accompanying diagrammatic drawing.

Figure 2:
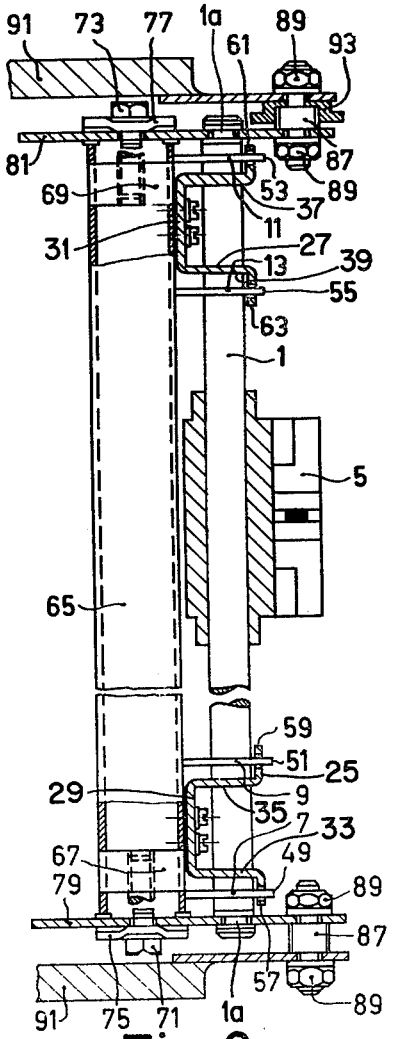
Figure 3:
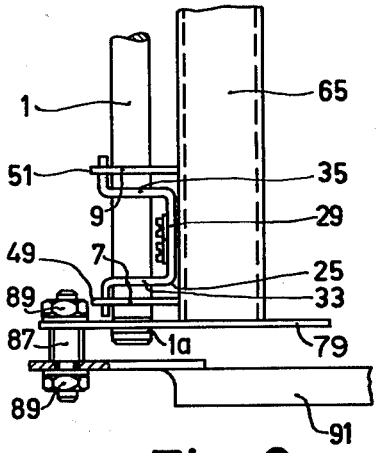
Figure 4:
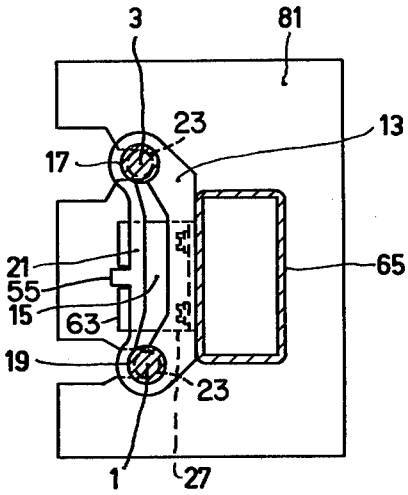
Figure 5:
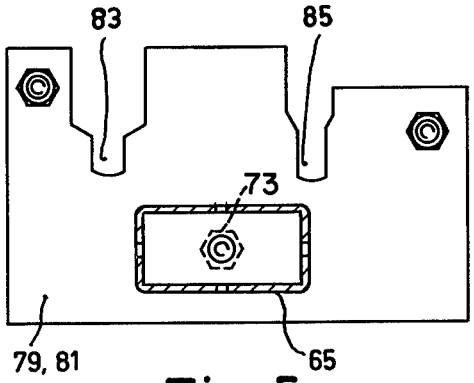

FIG. 1 is a plan view of a printing head with a guide in accordance with the invention, FIG. 2 is a longitudinal sectional view of the printing head with guide shown in FIG. 1, FIG. 3 is a front view of a part of the guide shown in FIG. 1, FIG. 4 is a cross-sectional view at an increased scale, taken along the line 4—4, of the guide shown in FIG. 1, and FIG. 5 is a cross-sectional view at an increased scale, taken along the line 5—5, of a part of the frame of the printing device in which the guide shown in FIG. 1 is secured.

The part of a printing device which is illustrated in the FIGS. 1 and 2 and which is used, for example, in bookkeeping equipment, comprises two mutually parallel, round guide rods 1 and 3 along which a printing head 5 is displaceable. The printing head 5 — a so-termed matrix printing head with printing pins — is detachably mounted on the guide rods 1 and 3 in a commonly used manner. The guide rods 1, 3 extend parallel to the printing direction and an anvil (not shown) which is not relevant in this context.

The guide rods 1 and 3 are maintained at a fixed distance from each other by clamps 7, 9, 11 and 13. The pair of clamps 7 and 9 is situated near the right end of the rods 1, 3 and, the pair of clamps 11 and 13 is situated near the left end of the rods 1, 3. The clamps 7, 9, 11 and 13 are sheet metal stampings and comprise (see FIG. 4) an elongate aperture 15 which is shaped near both ends so that round bearing apertures 17 and 19 are formed. Between the bearing apertures 17 and 19 there is situated an elongate bridge portion 21 which is flexible under the influence of forces which are directed transversely of the connecting line between the center of the bearing apertures 17, 19. The rods 1 and 3 are provided with two pairs of circumferential grooves near each of their ends. These grooves are each designated by the numeral 23. As will be apparent from FIG. 1 and FIG. 4 these four grooves cooperate with clamps 11, 13, 9, and 7. The diameter of the bearing apertures 17 and 19 is substantially equal to the diameter of the rods 1 and 3, so that the clamps 7, 9, 11 and 13 can be readily slid over the rods 1, 3 in their no-load condition, without the surface of the rods 1, 3 being damaged thereby. The clamps 7, 9, 11 and 13 are clamped around the rods 1 and 3 at the area of the circumferential grooves 23 by means of two clamping brackets 25 and 27. The clamping bracket 25 serves to secure the clamps 7 and 9, while the clamping bracket 27 serves to secure the clamps 11 and 13. The clamping brackets 25 and 27 are made of sheet metal and have a U-shaped section (see FIG. 3). Each clamping bracket 25, 27 comprises a planar bottom or bottom portion whose plane is parallel to the guide rods 1, 3 and which is arranged symmetrically relative to the center of these rods 1, 3. The clamping brackets 25 and 27 have bottom portions identified by the numerals 29 and 31, respectively, with legs 33, 35 and 37, 39 respectively, which extend perpendicularly to the bottom portions 29, 31. The legs 33, 35, 37 and 39 are bent outwards at right angles near their free ends in order to form the flanges 41, 43, 45 and 47, respectively.

These flanges 41, 43, 45, and 47 are provided with cut-outs 57, 59, 61, and 63 which cooperate with projections 49, 51, 53, and 55 formed on the clamps 7, 9, 11, and 13. The projections 49, 51, 53, and 55 respectively, project through cut-outs 57, 59, 61, and 63, respectively, of the flanges 41, 43, 45, and 47 (see FIG. 2). The bottoms 29 and 31 of the brackets 25 and 27 are screwed down on a supporting beam 65 which extends parallel to the longitudinal direction of the guide rods 1 and 3 and which has a rectangular hollow profile (see also FIG. 4). The supporting beam 65 is secured in the frame 91 of the printing device as will be described.

The distance between the lower sides of the clamping brackets 25 and 27 and the lower sides of the relevant flanges 41, 43 and 45, 47 is proportioned so that when the clamping brackets 25, 27 are screwed down, the flexible bridge portions 21 (see FIG. 4) exert a downward force on the flexible bridge portions 21. As a result, the clamps 7, 9, 11 and 13 disposed around the bearing apertures 17 and 19 (see FIG. 4) start to act as so-termed Seeger rings and grip around the guide rods 1 and 3.

The supporting beam 65 can be secured in the frame 91 of the printing device in various manners. However, the supporting beam 65 is preferably secured to be detachable and adjustable in the frame 91, because the guide rods 1, 3 with the printing head 5 can then be replaced as one unit and while the necessary parallel relationship of the guide rods 1, 3 relative to the printing direction and the anvil of the printing device is thus also ensured. The guide rods 1 and 3 are accurately maintained parallel relative to each other by the clamps 7, 9, 11 and 13 and the clamping brackets 25 and 27. A special method of securing the supporting beam 65 in the frame of the printing device so as to be detachable as well as adjustable (disclosed in German Patent Application No. P 2618001.8), is in principle as described hereinafter.

The supporting beam 65 is provided near both ends with members 67 and 69 which extend transversely of the longitudinal direction of the beam and which are secured in the beam 65. The members 67 and 69 comprise threaded transverse bores in which clamping bolts 71 and 73 are screwed (see FIG. 2). By means of the clamping bolts 71 and 73, the supporting beam 65 is secured, with intermediate clamping plates 75 and 77, to two side plates 79 and 81 which extend transversely of the longitudinal direction of the guide rods 1 and 3. The clamping plates 75 and 77 prevent bending of the comparatively thin side plates 79 and 81. The guide rods 1 and 3 are provided near both ends with annular grooves 1*a*, 3*a* which bear in recesses 83 and 85 provided in the side plates 79 and 81 (see FIG. 5). The recesses 83, being situated on the same side of the supporting beam 65, are slightly overproportioned relative to the diameter of the guide rods 1, 3 at the area of the annular grooves 1*a*, so that one of the guide rods 1 can "search" its ultimate position during the pressing of the flexible bridge portions 21 by the clamping brackets 25 and 27. The side plates 79 and 81 are secured in a frame 91 of the printing device by means of bolts and nuts 87 and 89. The unit formed by the guide rods 1, 3 and the side plates 79, 81 can be accurately positioned in the frame 91 by means of adjusting nuts 93.

The mutual distance between the clamps 7 and 9 and the clamps 11 and 13 is preferably chosen to be equal to approximately one twentieth part of the overall length of the guide rods 1 and 3 at a given diameter of the guide rods 1, 3. For example, if the guide rods 1, 3 have a length of 100 cm — which is often the case in bookkeeping machines — the said distance between the clamps 7 and 9, and the clamps 11 and 13 is preferably about 5 cm. The described ratio between distances and lengths ensures optimum resistance against bending of the guide rods 1, 3.

What is claimed is:

1. A printing device which comprises: means for printing on a line including a printing head, a frame carrying said printing head, a guide for directing said printing head parallel to said printing line, said guide including first and second parallel round guide rods each having first and second ends, said first end of said first rod being proximate said first end of said second rod, first and second side plates, said first side plate extending transversely of said guide rods and engaging said first ends of each guide rod, said second side plate engaging said second ends of said guide rods, said guide plates being carried by said frame, said guide rods being maintained at a predetermined fixed distance from each other by at least first and second clamps cooperating with said first ends of said guide rods and third and fourth clamps cooperating with said second ends of said guide rods, said clamps each extending transversely of the longitudinal direction of said guide rods and being generally planar, said clamps being provided with two communicating bearing apertures, said guide rods each having a plurality of circumferential grooves, each groove cooperating with one of said bearing apertures, each clamp including an elongate, flexible bridge portion which is disposed intermediate said two bearing apertures of each clamp, said rods being positioned in part by an outward force produced by said flexible bridge portion, said device further including a supporting beam which is detachably carried by said frame of said printing device, said supporting beam extending parallel to said guide rods, said clamps being carried by said supporting beam, said device also including a clamping bracket cooperating with each of said clamps and both of said rods to provide detachable mounting therebetween.

2. A printing device as claimed in claim 1 wherein said bridge portion is provided with a projection and said clamping bracket has an aperture dimensioned and configured for engagement with said projection to tend to prevent relative motion therebetween.

3. A printing device as claimed in claim 1 wherein (1) said first and second clamps and (2) said third and fourth clamps are symmetrically arranged relative to the center of the guide rods, the distance between said first and second clamps and between said third and fourth clamps relative to the overall length of the guide rods is approximately 1:20.

* * * * *